United States Patent [19]

Edelman

[11] Patent Number: 4,770,153

[45] Date of Patent: Sep. 13, 1988

[54] PNEUMATIC WEAPON WITH PRESSURE REDUCTION VALVES

[76] Inventor: Alexander S. Edelman, 5 Latingtown Woods Ct., Lattingtown, N.Y. 11560

[21] Appl. No.: 729,840

[22] Filed: May 2, 1985

Related U.S. Application Data

[63] Continuation-in-part of Ser. No. 652,688, Sep. 20, 1984, abandoned.

[51] Int. Cl.[4] ..... F41B 11/02; F16K 31/02; F41F 13/08

[52] U.S. Cl. ..... 124/72; 124/77; 137/505.11; 137/505.22; 251/63.6

[58] Field of Search ..... 84/129.02; 124/67, 69, 124/71, 72, 73, 74, 75, 76, 77, 32; 251/63.6, 349, 282; 137/505.22, 505.11

[56] References Cited

U.S. PATENT DOCUMENTS

| | | | |
|---|---|---|---|
| 645,932 | 3/1900 | Beck et al. | 124/72 X |
| 2,727,530 | 12/1955 | Grove et al. | 251/63.5 X |
| 2,784,712 | 3/1957 | Cassidy | 124/69 |
| 2,881,752 | 4/1959 | Blahnik | 124/75 |
| 3,212,489 | 10/1965 | Merz | 124/74 |
| 3,240,200 | 3/1966 | Jones | 124/75 |
| 3,456,554 | 7/1969 | Goodwin | 89/129.02 |
| 3,572,310 | 3/1971 | Chiba | 124/74 |
| 3,675,678 | 7/1972 | Lamping | 137/509 X |
| 3,818,887 | 6/1974 | Akiyama et al. | 124/67 |
| 4,280,248 | 7/1981 | Herubel | 124/75 X |

FOREIGN PATENT DOCUMENTS

| | | | |
|---|---|---|---|
| 465815 | 6/1950 | Canada | 124/69 |

*Primary Examiner*—Richard T. Stouffer
*Assistant Examiner*—D. Neal Muir
*Attorney, Agent, or Firm*—Blum Kaplan

[57] ABSTRACT

A pneumatic gun has a hollow cylindrical bolt which moves in a housing, being spring-biased to a cocked position. The bolt has a pressure inlet which is coupled to an outlet so that, when air under pressure is supplied to the inlet, the pressure and the drag of the air passing through the bolt urges it forward, carrying a projectile into the gun barrel. The air pressure is sustained until the projectile is propelled out of the barrel. A regulator valve reduces the pressure of gas from a holding tank in the weapon to the operating pressure of the control system. The required pressure for the firing valve may be derived from the control system, from a separate regulator, or from the holding tank. In one embodiment, a special firing valve controls the transmission of firing pressure to the bolt. A pneumatic firing control circuit is triggered by one, several, or a continuous series of electronic pulses to produce single, burst, or continuous fire. The pneumatic gun can be designed to simulate the operation of an automatic firearm.

33 Claims, 12 Drawing Sheets

FIG. 3
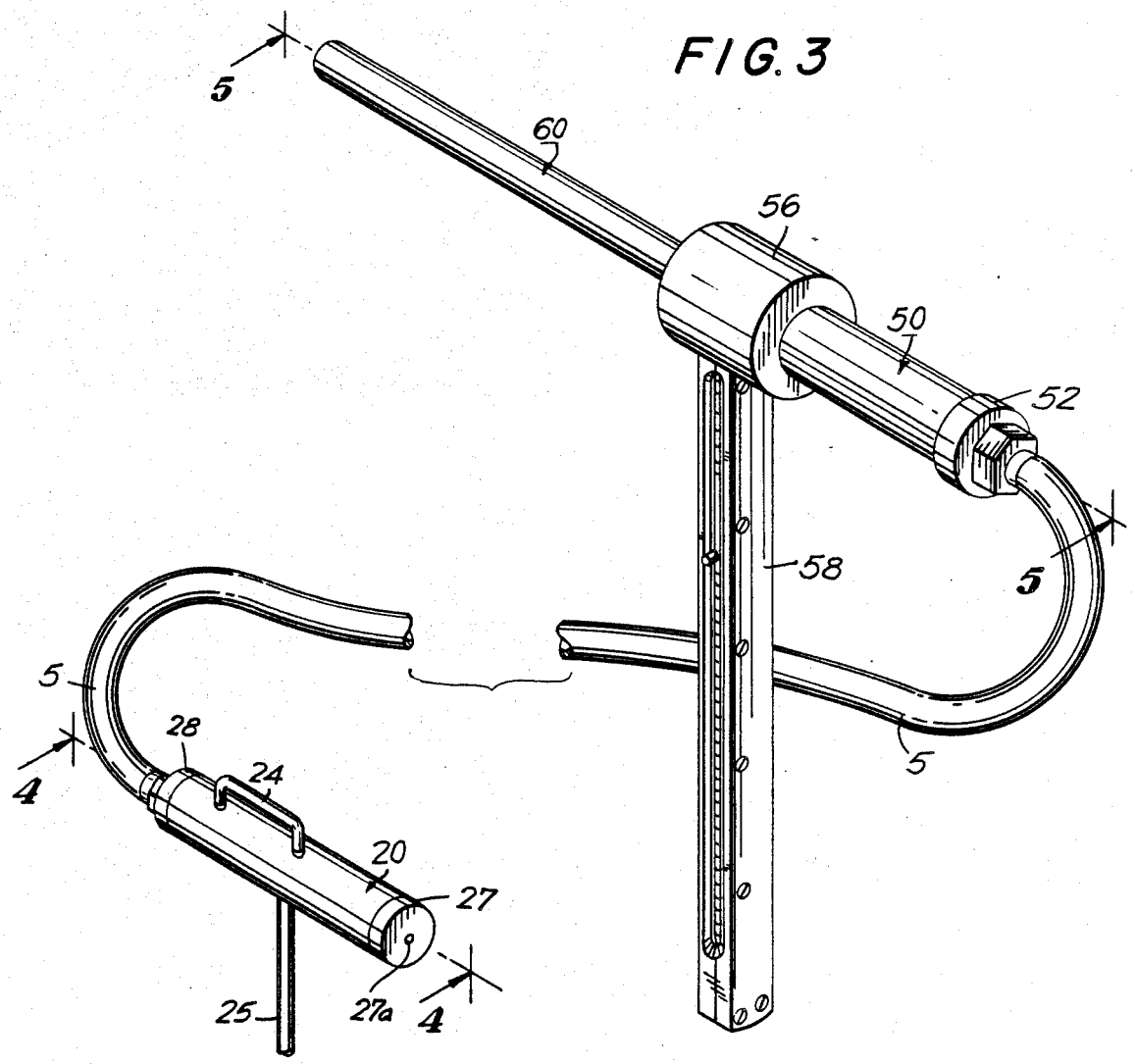
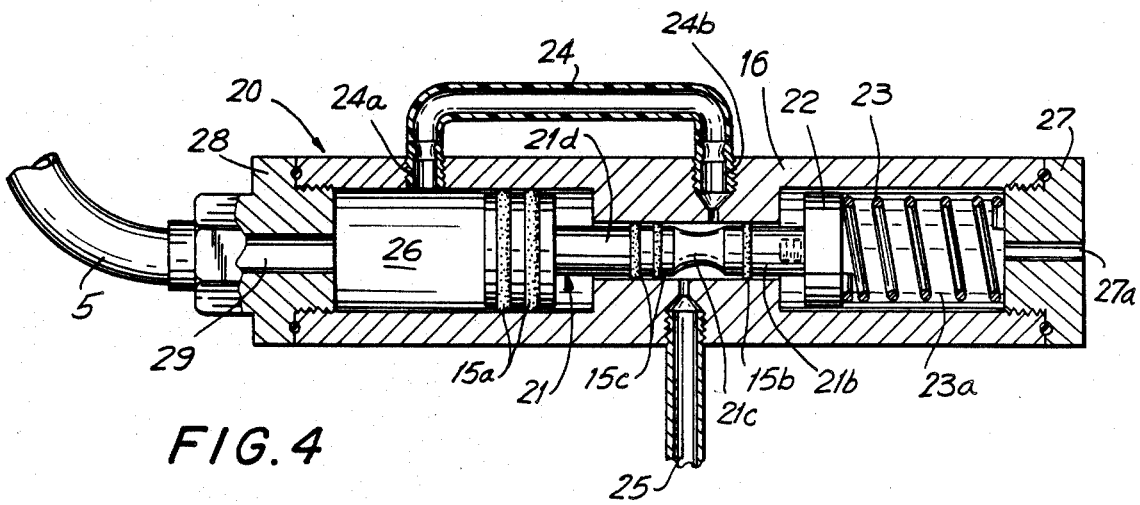
FIG. 4

PNEUMATIC WEAPON WITH PRESSURE REDUCTION VALVES

BACKGROUND OF THE INVENTION

This application is a continuation-in-part of U.S. patent application Ser. No. 652,688, filed Sept. 20, 1984 in the name of Alexander S. Edelman now abandoned.

This invention relates generally to a pneumatic weapon and more particularly to a pneumatic weapon that utilizes a pneumatically operated bolt assembly which is coupled to an electronic control system.

Conventional weapons utilize a chemical reaction in the form of an explosive charge to generate the force necessary to propel a projectile from a weapon. Weapons are also known which utilize air or some other compressed gas, rather than a chemical explosion, to generate the propelling force.

One example of such an air rifle is shown in U.S. Pat. No. 3,212,490 to I. R. Merz. These air rifles are manually cocked and are capable of firing only a single shot before recocking is necessary. Another, electric, air gun is shown in U.S. Pat. No. 2,568,432 to I. R. Cook. In this arrangement, an electric solenoid operates as a piston to create air pressure which is used to urge a pellet from a barrel. Cook, however, does not permit rapid multi-fire operation. The air rifles of the prior art each require a complex mechanical assembly which may be both expensive and difficult to manufacture. It is desirable to provide a pneumatically operated bolt assembly and an electronic control system for a weapon which can operate in a multi-fire mode, and which may be retrofitted into an existing weapon stock and barrel for training purposes.

SUMMARY OF THE INVENTION

Generally speaking, in accordance with the invention, an improved pneumatically operated bolt assembly and electronic control system for a pneumatic weapon is provided. The pneumatic bolt assembly includes a bolt and bolt housing which is coupled to a rifle barrel by means of a receiver. A magazine assembly is also coupled to the junction of the bolt housing and the rifle barrel at the receiver. The bolt assembly includes a reciprocating tubular pneumatic bolt having a passageway from an inlet for gas under pressure at its rearward end to an outlet at its forward end for supplying air to the projectile in the barrel. The bolt is moved forward in the bolt housing by the movement of the air through the passageway, and in some embodiments, the air inlet of the bolt is made larger in diameter than the outlet, so as to provide a constriction which increases the impedance presented to the moving air. In one embodiment, the constriction takes the form of a steplike reduction in diameter of the air passage. In another embodiment, the constriction is tapered and takes the form of a reverse curve. The pneumatic bolt is normally returned to a cocked position in the bolt housing by a bolt return spring and is provided with a stop for checking its forward motion.

In operation, a gas, such as air at a pressure substantially above atmospheric pressure, is directed at the inlet of the hollow bolt. Because of friction in the passageway through the bolt and because of the presence of a projectile in the receiver, air accumulates at the rear of the bolt body and the air pressure rapidly builds up, and the bolt is moved forward toward the barrel of the weapon. The impact of the bolt and the pressure of the air on the projectile cause the projectile to be impelled into the muzzle of the barrel and then out. The projectile movement results from a combination of both the striking contact by the bolt and the pressure of gas delivered behind the projectile from the outlet at the forward end of the bolt. As the bolt moves forward, its forward end blocks the flow of air out of the receiver via the magazine assembly and prevents any further projectiles from entering the receiver chamber, thereby reducing the possibility of jamming. The forward end of the bolt continues into the breech and then stops, while air under pressure continues to force the projectile forward. Once a projectile has been fired, gas under pressure is no longer supplied to the bolt and the pressure remaining within the bolt is free to escape via the barrel. The bolt, under the countervailing force of the bolt return spring, then returns to the starting position, allowing another projectile to enter the receiver so that the process may be repeated.

The flow of high pressure to the bolt assembly is regulated by an electronically controlled pneumatic system. In one embodiment, the control system utilizes a pulse generating circuit which provides an electric control signal to an electronic/pneumatic fire control valve. When the fire control valve is opened under electronic control, a low pressure pneumatic control signal is allowed to flow through. The control signal actuates an air pilot actuator valve which, in turn, controls a firing valve. The firing valve gates the flow of high pressure air directly to the pneumatic bolt assembly pressure inlet.

The solid state pulse circuit may generate a single pulse to allow single shot action or it may generate a series of pulses for burst or rapid fire operation.

In a preferred embodiment of the invention, the gas used is compressed air at high pressure, which can be provided to the pneumatic bolt and the control system from a storage tank located within the weapon. This high pressure is converted to a lower, working pressure by means of a high pressure regulator. The high pressure regulator employs a valve having a shuttle and a return spring. High pressure enters the high pressure regulator and flows through a passage in the center of the shuttle valve and via a crossover manifold into a low pressure chamber. As pressure builds up in the low pressure chamber, the shuttle valve is forced against the return spring. When the pressure is sufficient, the shuttle valve moves against the return spring, shutting off the high pressure inlet and stopping the further flow of high pressure. A constant level of pressure is maintained in the low pressure chamber since, upon release of pressure from the low pressure chamber outlet, the shuttle is forced to the open position by the return spring, thereby repeating the cycle. By varying the characteristics of the shuttle valve return spring, the pressure maintained in the low pressure chamber may be adjusted to a suitable level.

In one embodiment of the invention, the invention provides a high pressure firing valve for controlling the delivery of high pressure air to the pneumatic bolt so as to provide a high rate of fire at the same time that the muzzle velocity of projectiles discharged by the weapon is increased.

Accordingly, it is an object of the invention to provide an improved pneumatically operated bolt assembly and electronic control system for a weapon.

Another object of the invention is to provide an improved pneumatically operated bolt assembly and electronic control system for a pneumatic weapon which utilizes a high pressure regulator valve.

A further object of the invention is to provide an improved pneumatically operated bolt assembly and electronic control system for a pneumatic weapon which may be retrofitted into an existing weapon housing.

Still another object of the invention is to provide an improved pneumatically operated bolt assembly and electronic control system for a pneumatic weapon which may be fired in either a single shot or a multiple shot manner.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a perspective view of a reciprocating pneumatic bolt, receiver and barrel assembly and a high pressure regulator valve according to the present invention;

FIG. 4 is a cross-sectional view of the high pressure regulator of FIG. 3 taken along line 4—4 of FIG. 3;

DETAILED DESCRIPTION OF THE INVENTION

Figure 1:
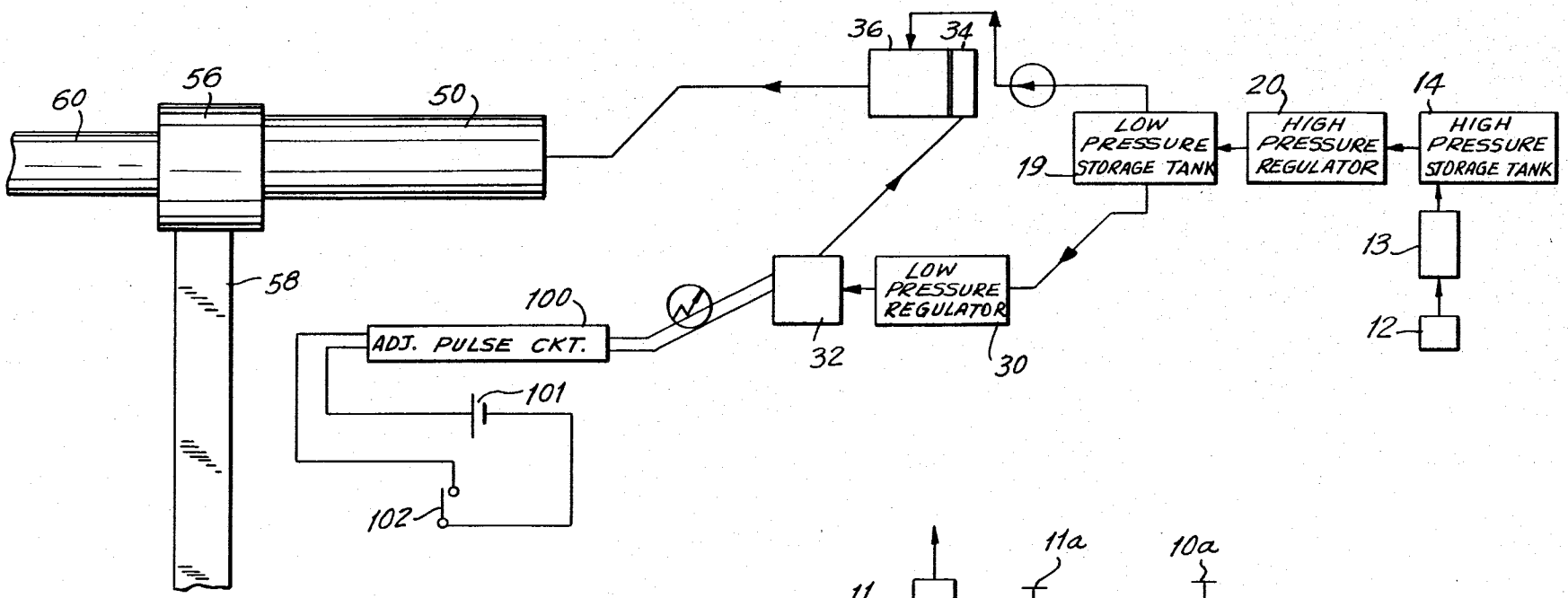
FIG. 1 is a schematic diagram of an electronic/-pneumatic weapon in accordance with the present invention.
Figure 2:
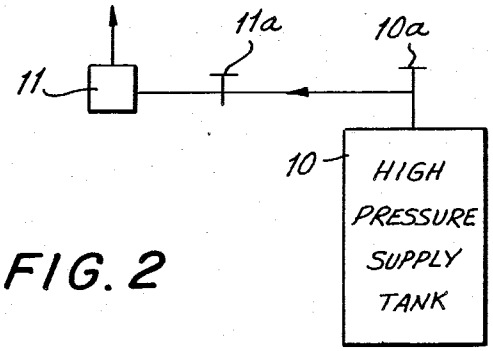
FIG. 2 is a schematic diagram of a high pressure source which may be used in conjunction with the present invention.

A schematic diagram of an electronically controlled pneumatic weapon according to the invention is shown in FIG. 1. There, a compressed gas fill connection 12 couples input air through a high pressure check valve 13 into a high pressure storage tank 14 which, along with a low pressure tank 19 and various valves to be described, may be located in the gunstock. High pressure check valve 13 serves as an emergency release port in case of a malfunction during the filling of high pressure storage tank 14 and conveniently opens at approximately 20% above pressure. Compressed gas, usually air, may be supplied to coupling 12 from an external high pressure supply tank 10 which is temporarily coupled to fill connection 12 by a compressed gas tank fitting 11. High pressure supply tank 10 is provided with a high pressure tank valve **10*a* and compressed gas tank fitting 11 includes a compressed tank fitting three-way line exhaust valve 11*a*. These two valves allow the safe filling of storage tank 14** with a minimum amount of effort.

Referring once again to FIG. 1, it is noted that in the preferred embodiment, compressed gas stored in high pressure storage tank 14 is held at a pressure of approximately 3000 psi. This pressure is, however, too high to be utilized by the pneumatic bolt and control system of FIG. 1 directly, and so is first reduced to a working pressure of approximately 300 psi. This pressure reduction is accomplished through the use of high pressure regulator 20 which typically may have an input in the range of between 0 and 3000 psi and can be adjusted to deliver a pressure typically in a range between 0 and 300 psi. The 300 psi pressure outlet of high pressure regulator 20 is coupled to low pressure storage tank 19 and thence to the input of firing valve 36. Air from the low pressure storage tank is also coupled to a low pressure regulator 30 which takes an input in the range of 0 to 300 psi and delivers a pressure output in the range of 0 to 100 psi. (For more powerful weapons, regulators delivering higher pressures may be required.) This lower pressure, 100 psi, output is used as a source of a pneumatic control signal, being fed as an input to fire control valve 32. Fire control valve 32 responds to the output of adjustable pulse circuit 100 in which an electric control signal is generated in response to the closing of switch 102 which is connected in series with power source 101. When switch 102 is closed, for example when the trigger of the weapon is pulled, an electric pulse is generated which is coupled to electronic/-pneumatic fire control valve 32. Fire control valve 32 responds, allowing a low pressure, 100 psi, signal to flow from low pressure regulator 30 to actuate an air pilot actuator valve 34 on firing valve 36.

Air pilot actuator valve 34 employs a single-acting return spring and has an operating pressure in the range of between 5 and 250 psi. Air pilot actuator valve 34 is capable of yielding a force factor of 0.6. When air pilot actuator valve 34 is actuated, it causes normally closed firing valve 36 to open, thereby supplying 300 psi air from low pressure storage tank 19 to a reciprocating/-pneumatic bolt assembly 50. Bolt assembly 50 is coupled to a rifled barrel 60 through a receiver 56 which also supports an ammunition magazine 58.

Fire control valve 32 is an electronic/pneumatic three-way poppet valve which is preferably bubble tight and normally closed. In a working model of the weapon, the valve's poppet had a travel of approximately 0.010 inches and operated within a pressure range of 0 to 105 psi. The poppet valve had an operating voltage in the range of between 5 and 9 volts and a power consumption at rated voltage of approximately 0.65 watts. In addition, in this working embodiment, firing valve 36 was a normally closed, two-way poppet valve having a stem travel distance of approximately ⅛ of an inch. Normally closed, two-way poppet valve 36 operates at a working pressure in the range of 0 to 300 psi and has an air flow at 50 psi of 14 cfm and an air flow at 100 psi of 25 cfm. Such valves are manufactured by Clippard Instrument Laboratory, Incorporated, of 7340 Colerain Road, Cincinnati, Ohio, being, respectively, a type EV-3 electronic/pneumatic, normally closed, three-way pneumatic valve, and a type MJV two-way pneumatic valve. FIG. 3 shows the components of the pneumatic weapon system described above in perspective view.

FIG. 4 shows a cross-sectional view of a high pressure regulator 20 forming part of the invention. High pressure regulator 20 incorporates a hollow valve body 16 which, at one end, defines low pressure chamber 26 to which high pressure inlet 25 and low pressure outlet 29 are connected. High pressure regulator 20 employs a single moving part, valve shuttle 21. First end **21*a* of shuttle valve 21 is located in low pressure chamber 26 and provides a piston on which air in chamber 26 can press. Shuttle 21 also has second end 21*b* which is biased toward low pressure chamber 26 by shuttle end 21*b* and receives the force of shuttle valve return spring 23. The central part of shuttle 21 is stem 21*d* which is provided with a reduced cross section, proximate to its center, creating shuttle stem flow passage 21*c*, through which compressed gas may flow. Low presssure chamber 26 can communicate with high pressure inlet 25 through shuttle stem flow passage 21*c* when the inlet is not blocked by stem gaskets 15*c*. In the embodiment of FIG. 4, the high-pressure-to-low-pressure cross-over manifold 24 is provided external of valve body 16. Low pressure end 24*a* of crossover manifold 24 communicates with low pressure chamber 26. High pressure end 24*b* of crossover manifold 24 communicates with the reduced diameter section of the regulator body in which the shuttle stem 21*d*** travels.

Valve body 16 also defines spring chamber **23*a*. Spring 23 is held inside spring chamber 23*a* by end cap 27. End cap 27 is formed with a vent 27*a* to permit the compression of spring 23 without a buildup of pressure inside spring chamber 23*a*. Low pressure outlet 29 is coupled to low pressure chamber 26 through a low pressure chamber end cap 28**.

A plurality of sealing rings **15*a*, 15*b*, and 15*c* of a conventional "O" ring type, are provided along the body of shuttle valve 21. They support movement of the shuttle inside valve body 16 while providing pressure seals between the internal valve body chambers. Rings 15*c* also close off gas flow from high pressure inlet 25 to low pressure outlet 24**.

In operation, high pressure gas of approximately 3000 psi enters regulator 20 via high pressure inlet 25. When pressure in low pressure chamber 26 is low, the high pressure gas is allowed to flow through valve stem flow passage **21*c* into cross-over manifold 24 and thence into low pressure chamber 26. As pressure builds up in low pressure chamber 26 of the valve, shuttle 21 begins to press against return spring 23. When shuttle valve 21 moves sufficiently against return spring 23, valve stem flow passage 21*c* is moved away from its initial position, causing high pressure inlet 25 to be blocked between "O" rings 15*c* on of shuttle stem 21*d*. This action stops the further flow of high pressure and provides the desired pressure in low pressure chamber 26. When the weapon is fired, gas stored in low pressure chamber 26 is released via low pressure chamber outlet 29. Shuttle 21 is then moved forward by return spring 23, permitting high pressure to enter the valve and repeating the above-described cycle. It is to be noted that shuttle valve return spring 23 is the determining factor for setting the level of pressure that may be maintained in low pressure chamber 26. The more the energy stored in spring 23, the higher the pressure that will be established in low pressure chamber 26** before it is shut off from the supply.

Figure 5:
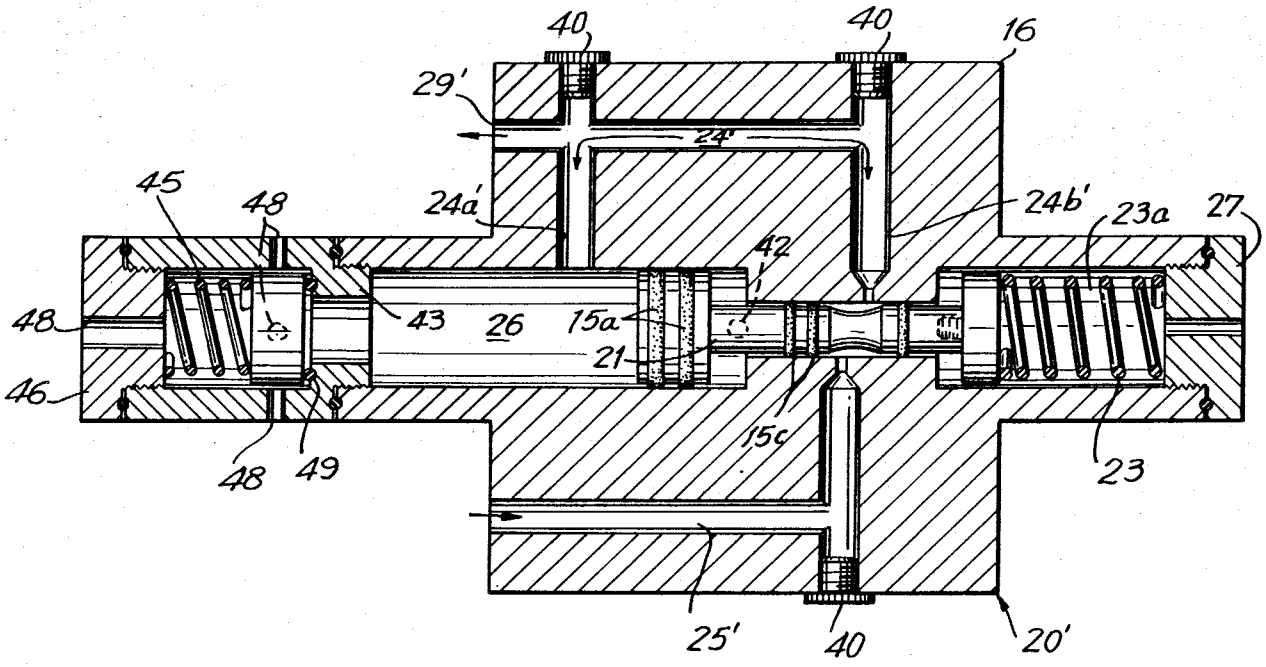
FIG. 5 is a cross-sectional view of an alternative embodiment of a high pressure regulator useful with the bolt, receiver, and barrel of FIG. 3.

An alternative embodiment of the high pressure regulator valve is shown in FIG. 5 where elements corresponding to those of the regulator valve in FIG. 4 and performing the same function are identified by the same number. Parts which have been modified are marked with a prime. Thus, in FIG. 5, high pressure regulator valve 20' has valve body 16' of a larger size than that of FIG. 4 and which contains the previously described chambers in which valve shuttle 21 moves back and forth to control the pressure at which air is supplied to the weapon via vertically and horizontally oriented holes drilled into enlarged valve body 15. The cross-over manifold 24', with its respective input and output portions **24*b*' and 24*a*' is now contained within the body. High pressure inlet 25' is now oriented so that, like the outlet 29' from the crossover portion of manifold 24' the attachment of hose connections parallel to the body can be accomplished. The outside openings of the vertical passageways by which the lengthwise passages 24' and 25' are connected to the valve chambers are plugged by means of tapped machine screws 40** which are conventionally seated on lead or Buna S gaskets. The structure is compact and lends itself readily to inclusion in the gunstock of the weapon.

The high pressure regulator valve of FIG. 5 also includes a relief valve having relief valve body 44. Body 44 includes an enlarged cylindrical portion attached to a reduced nipple portion 43 which is threaded into low pressure chamber 26. End plug 46, screwed into the enlarged portion, provides a seat for relief valve spring 45 which presses relief valve piston 47 against O ring 49. O ring 49 is seated on the ledge provided at the point of attachment of relief valve body 44 to nipple 43. Vents 48 in plug 46 permit the escape of air which may become entrapped within the relief valve operational space. As will be understood by those skilled in the art, the pressure at which the relief valve operates is established by the force level in compressed spring 45 and depends on the characteristics of the spring and the degree of compression. While these parameters are usually set at the time of manufacture, it is understood that the relief valve setting can be adjusted by changing springs or by screwing the end plug in or out.

Figure 6:
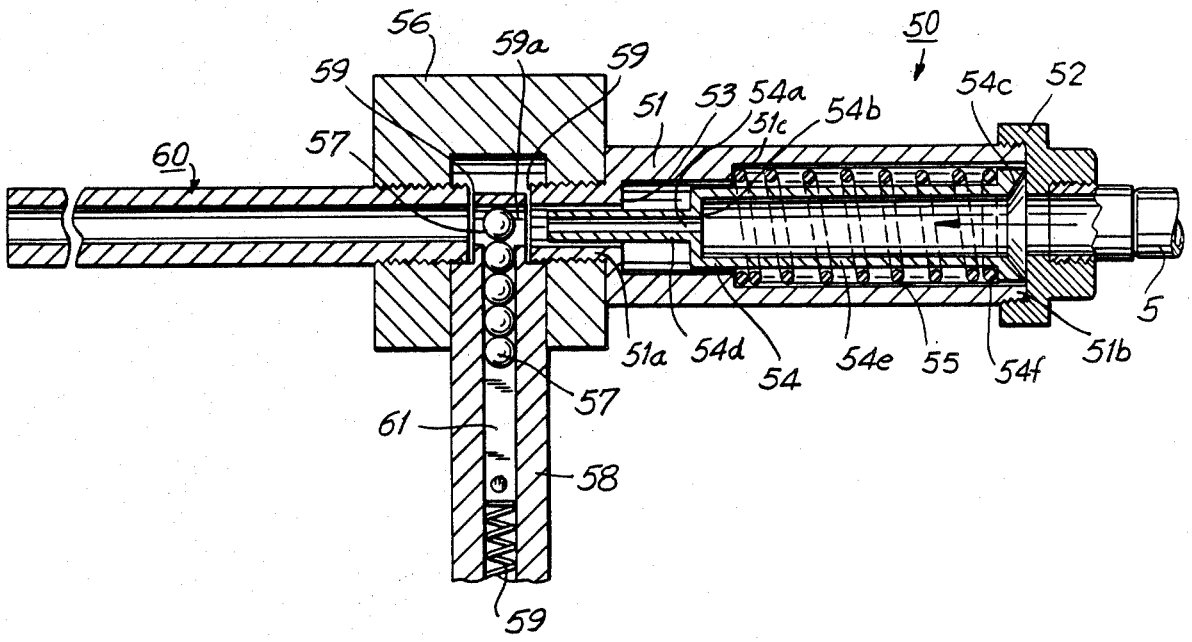
FIG. 6 is a cross-sectional view taken along line 5—5 of FIG. 3 illustrating a reciprocating bolt assembly at a first point in a time sequence of operation in accordance with the present invention.

In FIGS. 6, 7, 8, and 9, the construction and operation of a reciprocating pneumatic bolt and magazine assembly according to the invention is shown in a series of illustrations showing operation of the invention at different points in time. As shown in FIG. 6, the reciprocating pneumatic bolt and magazine assembly of the weapon has a bolt housing 51 which communicates coaxially, at receiver 56, with rifled barrel 60 and which supports magazine 58. Bolt assembly 50 has tubular bolt housing 51, whose forward end 51*a* is coupled to receiver 56; the rearward end is designated 51*b*. Forward end 51*a* has a smaller cross-sectional diameter than the main tubular sections in second end 51*b*.

The weapon employs a hollow, elongated bolt 54 which has a main tubular section 54*e* which is connected to a projecting tubular section 54*d* by transverse wall 54*b*. Bolt 54 is designed to travel axially inside of bolt housing 51 from a withdrawn position to which it is urged by the action of compressed coil spring 55 between housing shoulder 51*c* and bolt end flange surface 54*f*. When propelled by gas under pressure from connecting hose 5, bolt 54 is urged away from the hose in the direction of the arrow, and reduced portion 54*d* travels within the nipple which connects bolt chamber 51 to receiver block 56. Within receiver block 56, the nipple of bolt 51 opens into a space which also receives the inner end, or muzzle, of rifled barrel 60. The nipple, bolt and barrel are positioned on a common axis so that the reduced end portion 54*d* of bolt 54, when it travels into the space between the rifle and the bolt housing within receiver block 56, will strip a projectile 57 from its loaded position within eyelet 59*a* of magazine 58. Ammunition magazine 58 is attached to receiver 56 so as to feed pellets 57, one at a time, to an axial position between bolt housing 51 and rifled barrel 60. Magazine 58 holds a plurality of suitable projectiles. It will be understood that a variety of air propelled projectiles such as BB's, #4 buckshot, conical projectiles and the like, can be employed. These projectiles are urged towards receiver 56 by the force exerted on magazine follower 61 by magazine follower spring 59.

Sequential operation of the reciprocating pneumatic bolt and magazine assembly of the invention, in a single shot mode of operation, will now be described. Referring first to FIG. 6, when the weapon is actuated, a burst of 100 to 300 psi pressure gas enters bolt housing 51 from inlet tube 51. Because pressure outlet 54*a* of bolt 54 is smaller than pressure inlet 54*b*, pressure builds up inside of the bolt. The force developed due to the pressure buildup is quickly sufficient to cause compression of bolt return spring 55, and bolt 54 moves forward at a high rate of speed. It is to be noted that the incoming gas pressure presses upon lateral bolt wall 54*b* and on conical end face 54*c* of the bolt, propelling bolt 54 into contact with the projectile in eyelet 59*a*. The projectile is then picked up and moved rapidly forward by the bolt until the bolt reaches the end of its travel. The flow of gas through the bolt continues to press upon the projectile until it has left the rifle bore. It is a feature of the invention that the hollow bolt has a reduced end portion which can contact the projectile and carry it into the barrel, as well as a larger diameter portion which travels in the bolt chamber. The bolt provides both a through passage for air to drive the projectile as well as providing substantial surface area for air drag, with a constriction at the transverse wall and added area at the inlet end, all of which contribute to propelling the bolt.

Figure 7:
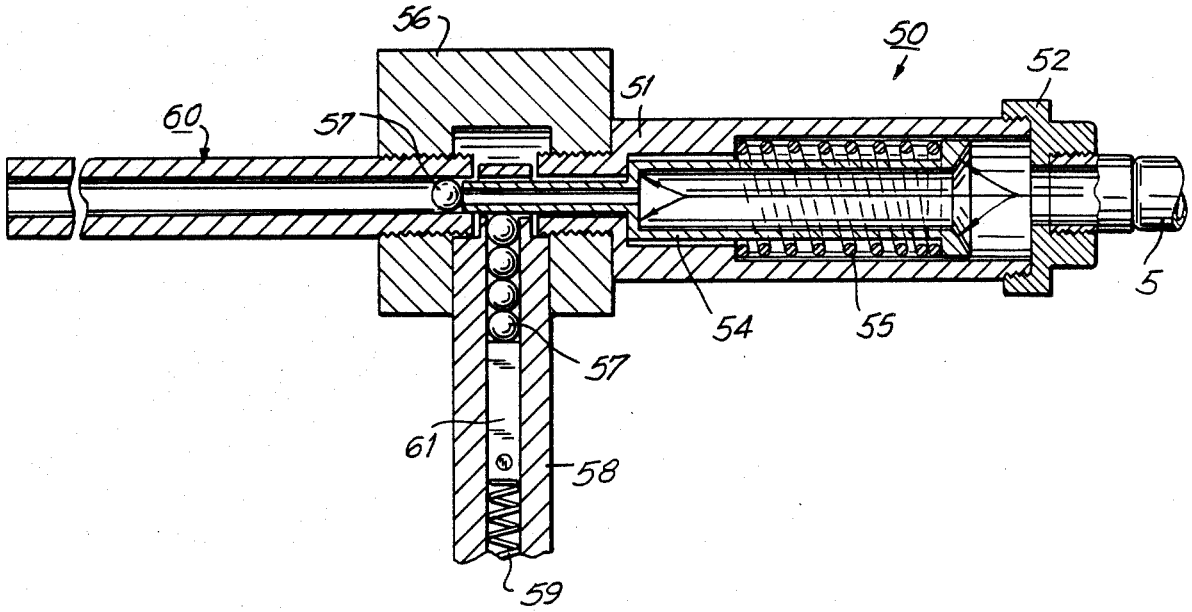
FIG. 7 is a second point in the time sequence illustration of the reciprocating pneumatic bolt assembly of FIG. 6.

As can be seen in FIG. 7, when bolt 54 moves forward, it strikes a projectile 57 which is held in the eye of magazine 58. As projectile 57 is moved into barrel 60, the presence of bolt 54 in the eye of the magazine effectively seals the gaps around it as well as preventing the next projectile in line in magazine 58 from moving up. This helps to prevent jamming. Forward movement of bolt 54 is stopped when the transverse wall of the bolt contacts bolt housing shoulder 53.

Figure 8:
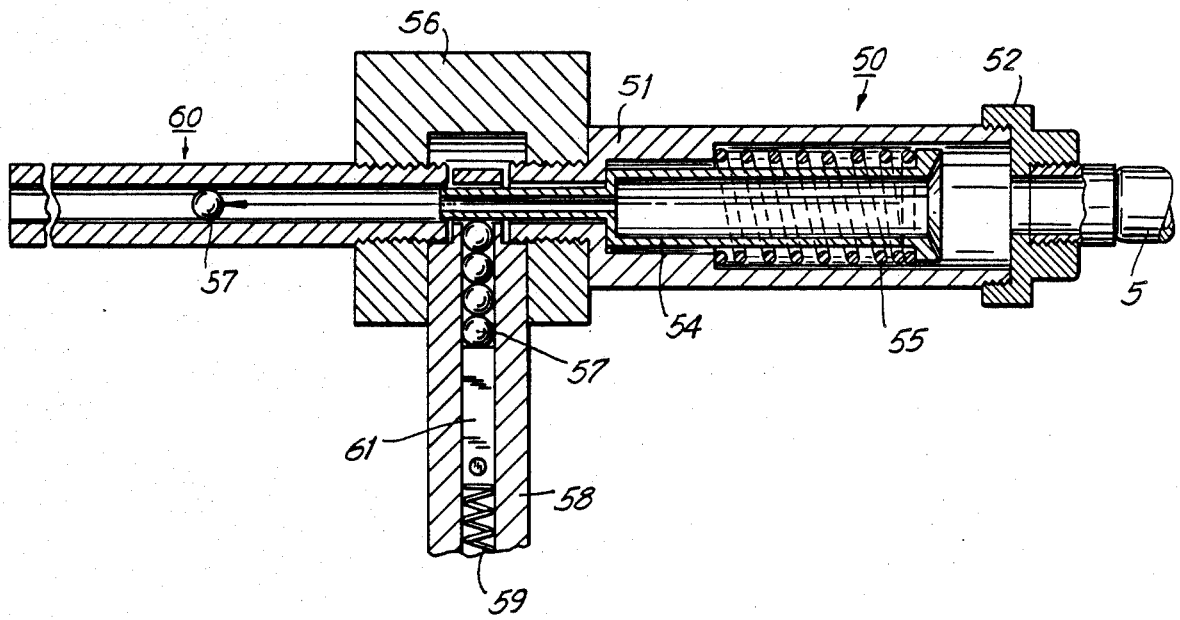
FIG. 8 is a third point in the time sequence illustration of the reciprocating pneumatic bolt assembly of FIG. 6.

Referring to FIG. 8, once bolt 54 has ceased its movement, the pressure within the bolt continues to escape through pressure outlet 54*a*, thereby further providing a force directed down the barrel of the weapon, which in turn aids in the expulsion of projectile 57.

Figure 9:
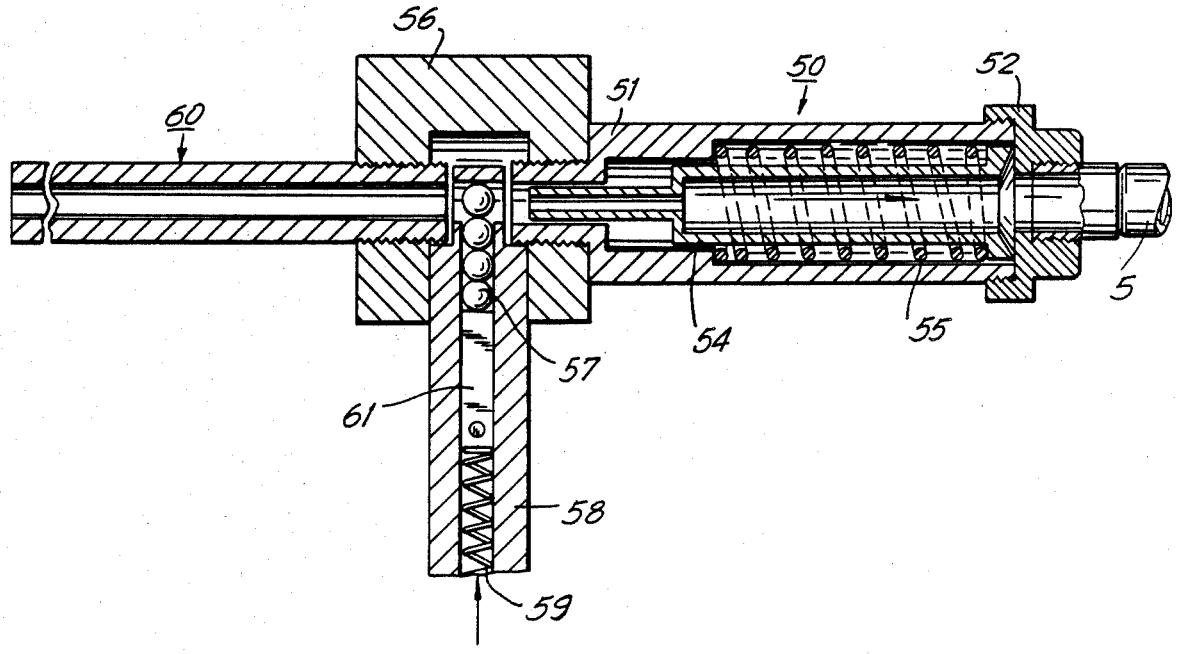
FIG. 9 is a fourth point in the time sequence illustration of the reciprocating pneumatic bolt assembly of FIG. 6.

As can be seen in FIG. 9, after the projectile has left the rifle barrel, pressure behind the bolt diminishes, permitting bolt return spring 55 to return bolt 54 to its starting position and allowing the next projectile from the magazine to enter the eyelet.

The above-described operating sequence is advantageous in that the forward movement of the bolt stops the next projectile in line from interfering with the movement of the preceding projectile. In addition, by directing the flow of pressure down the barrel behind the projectile, pressure losses, which would otherwise occur through the space surrounding the magazine and the receiver, are minimized. Finally, due to the combined effect of the impact of the bolt and the sustained pressure application, more thrust is applied to the projectile. This allows the user to obtain realistic handling qualities while at the same time using a much less powerful projectile at a much lower cost per shot basis.

As noted above, the pneumatic mechanism may be fired under the control of a solid state adjustable pulse circuit. In the preferred embodiment, three modes of fire may be selected:

1. Semi-automatic, where one shot is provided with each pull of a trigger;
2. Burst fire, where a plurality, such as three shots, are provided with each pull of the trigger at a rate of approximately 400 shots per minute; and
3. Automatic fire, where continuous fire is provided as long as a trigger is pulled at a rate of approximately 400 shots per minute.

While one rate of fire is provided in the above embodiment, it will be understood by those skilled in the art that the rate of fire can be varied by suitable changes in the electronic circuitry which controls the weapon.

Figure 10:
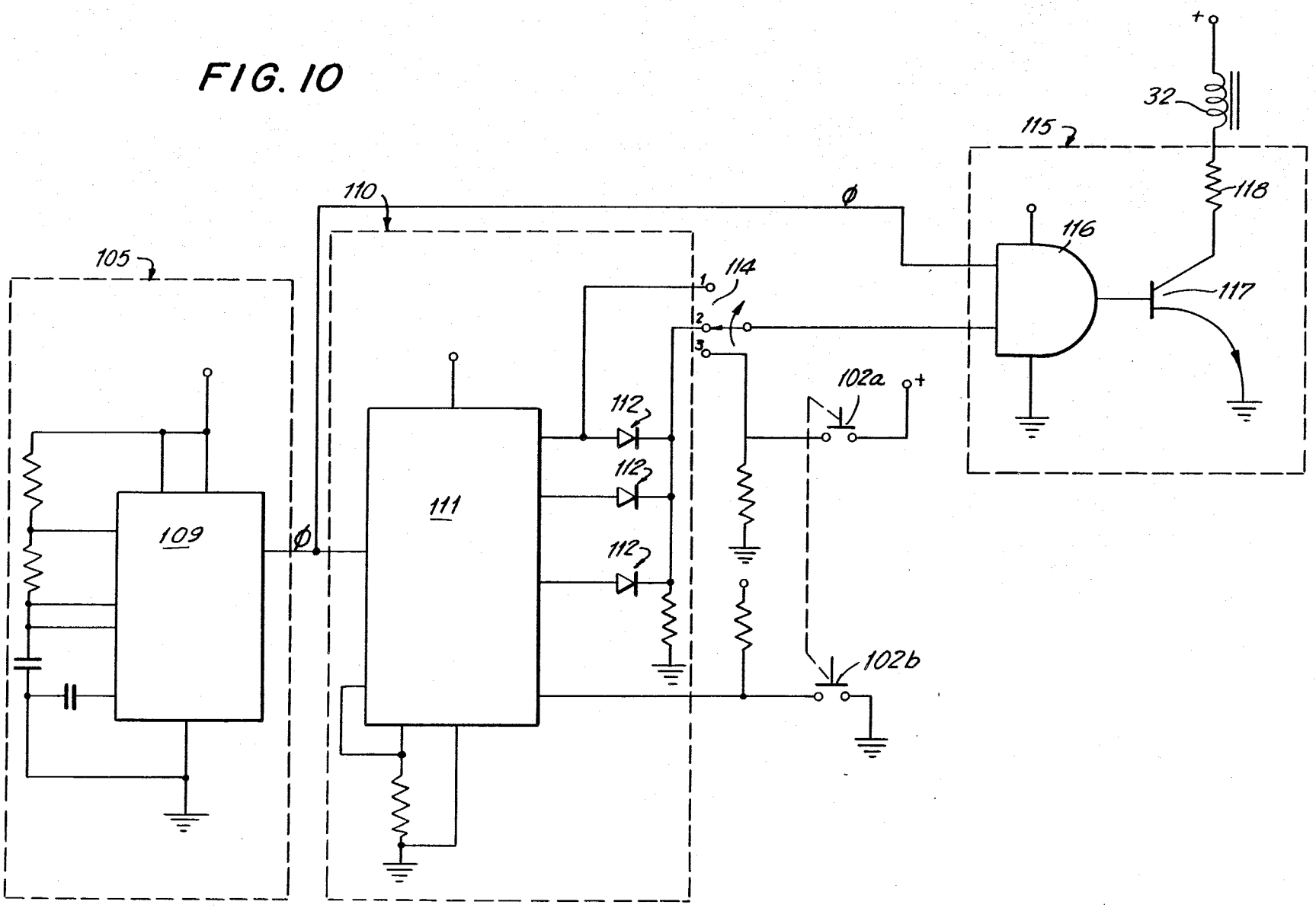
FIG. 10 is a schematic diagram of an electronic control system in accordance with the present invention.

An electronic control circuit 100 for generating the desired electrical pulse signals is illustrated in FIG. 10. The pulse generating circuit utilizes a pulse generator 105, a counter circuit 110 and an output switching and buffer circuit 115. Pulse generator circuit 105 utilizes a bi-stable multi-vibrator 109 (which may be a type 555) and is, by means of appropriate resistors and capacitors, configured to produce a continuous train of pulses in a manner well known in the art. The output of this oscillator is fed as a clock input to logic counter 111 in counter circuit 110, being also fed to one input of AND gate 116 in output switching and buffer circuit 115. Logic counter 111 may be a multi-decade counter, such as a COS/MOS CD 4017. This integrated circuit provides separate first count, second count, and third count output signals. These signals are coupled together through buffering diodes 112 to position 2 of the switch 118 in the output switching and buffer circuit 115. The output from selector switch 114 is fed to the other input terminal of AND gate 116. The output of AND gate 116 is coupled through a transistor 117 and pull-down resistor 118 to the solenoid of fire control valve 32, which it controls. In position 1, three-way operating switch 114 is connected to the first output of counter 111 and, in position 3, via one section of trigger switch 102, to the supply voltage.

In operating position 3, three-way switch 114 receives a continuous logic "1" signal whenever trigger switch 102 is closed so that a continuous string of pulses from multi-vibrator 109 is coupled directly through AND gate 116 and transistor 117 to fire control valve 32, thereby allowing continuous rapid multi-fire operation. As will be apparent to those skilled in the art, the rate of fire of the weapon is determined by the rate at which pulses are supplied by pulse generator 105. In operating position 2, the second input of AND gate 116 is connected to the combined outputs of the first count, second count, and third count sections of the counter. Now, when the second section trigger switch 102 is closed, the logic "1" signal provided to the second input of AND gate 116 lasts long enough to permit passage of three pulses from counter 111. This causes fire control valve 32 to be actuated three times in rapid succession. Finally, when the second input of AND gate 116 is in operating position 1, the second input is connected directly to the first count output of counter 111, thereby providing the AND gate with a single pulse of logic "1" and, hence, single shot duration, every time the trigger is closed.

Figure 11:
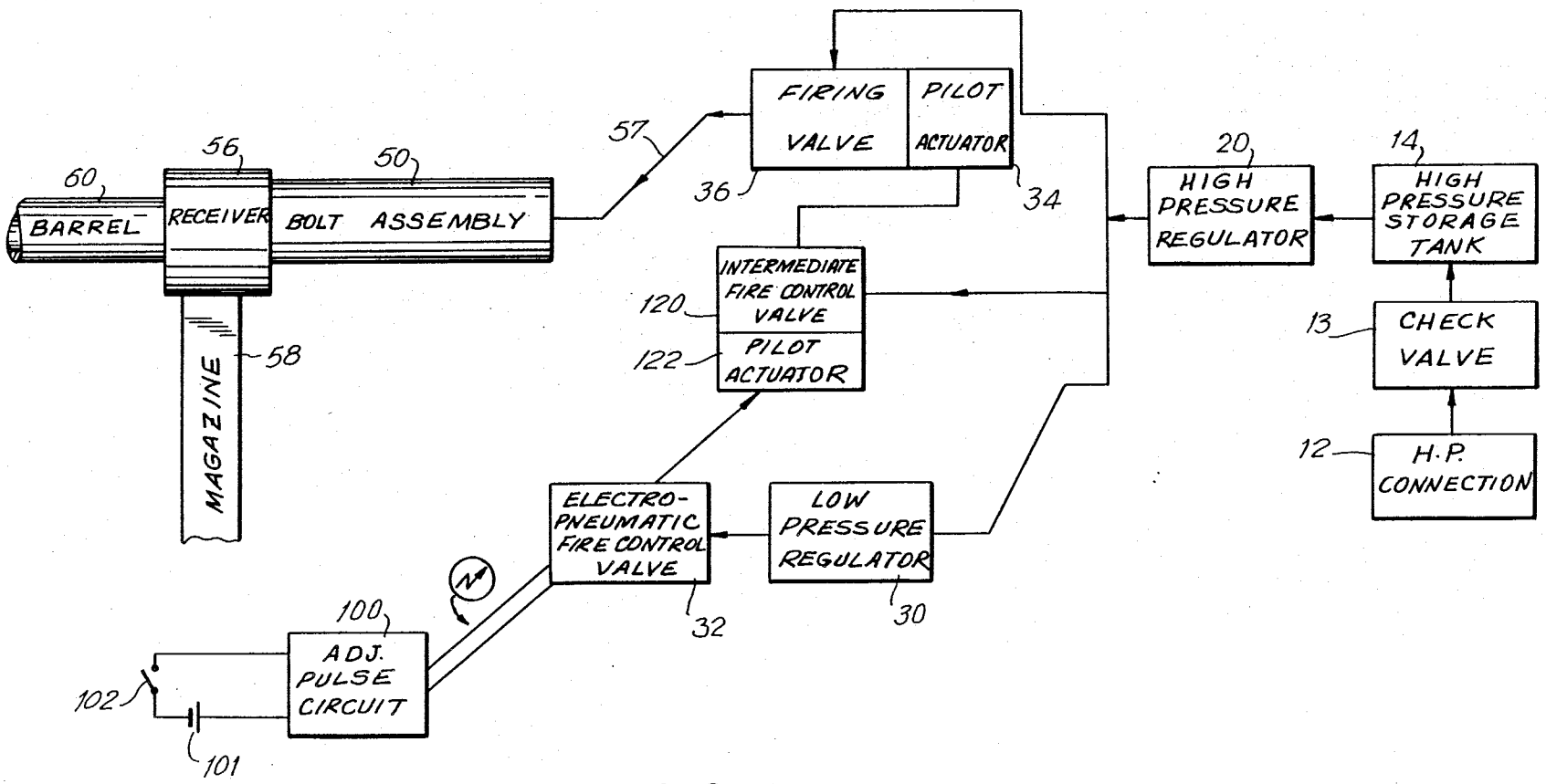
FIG. 11 is a schematic diagram of an electronic/-pneumatic weapon employing an alternative pneumatic control system in accordance with the present invention.

FIG. 11 is a schematic diagram showing the electronically controlled pneumatic weapon of FIG. 1, modified for triggering firing valve 36 when the pneumatic pressure in the circuit is above 150 psi, and also to make the system more reliable when firing valve 36 is remote from electronic/pneumatic fire control valve 32. The use of the elevated pressure also eliminates the need for the low pressure storage tank 19 of FIG. 1, removing a component of substantial size from the assemblage of components which are to be fitted into the stock of a weapon. Since this medium pressure level increases the force required to trigger firing valve 36, and since pressures above about 100 psi cannot be handled by the electronic/pneumatic fire control valve 32 used in the working embodiment of FIG. 1, a normally closed, three-way poppet valve which is capable of handling the pressure is used as intermediate fire control valve 120. Valve 120 provides a pneumatic control signal at an elevated pressure, by controlling air supplied from high pressure regulator 20 to firing valve pilot actuator 34. To this end, the output of fire control valve 32 is now fed to a single-acting, spring-return, air pilot actuator 122 for initiating the action of intermediate fire control valve 120, which in turn couples medium pressure air to the input of firing valve pilot actuator 34. As indicated by the numbering, the remaining components of the system of FIG. 11 are the same as in FIG. 1 and perform the same functions.

Figure 12:
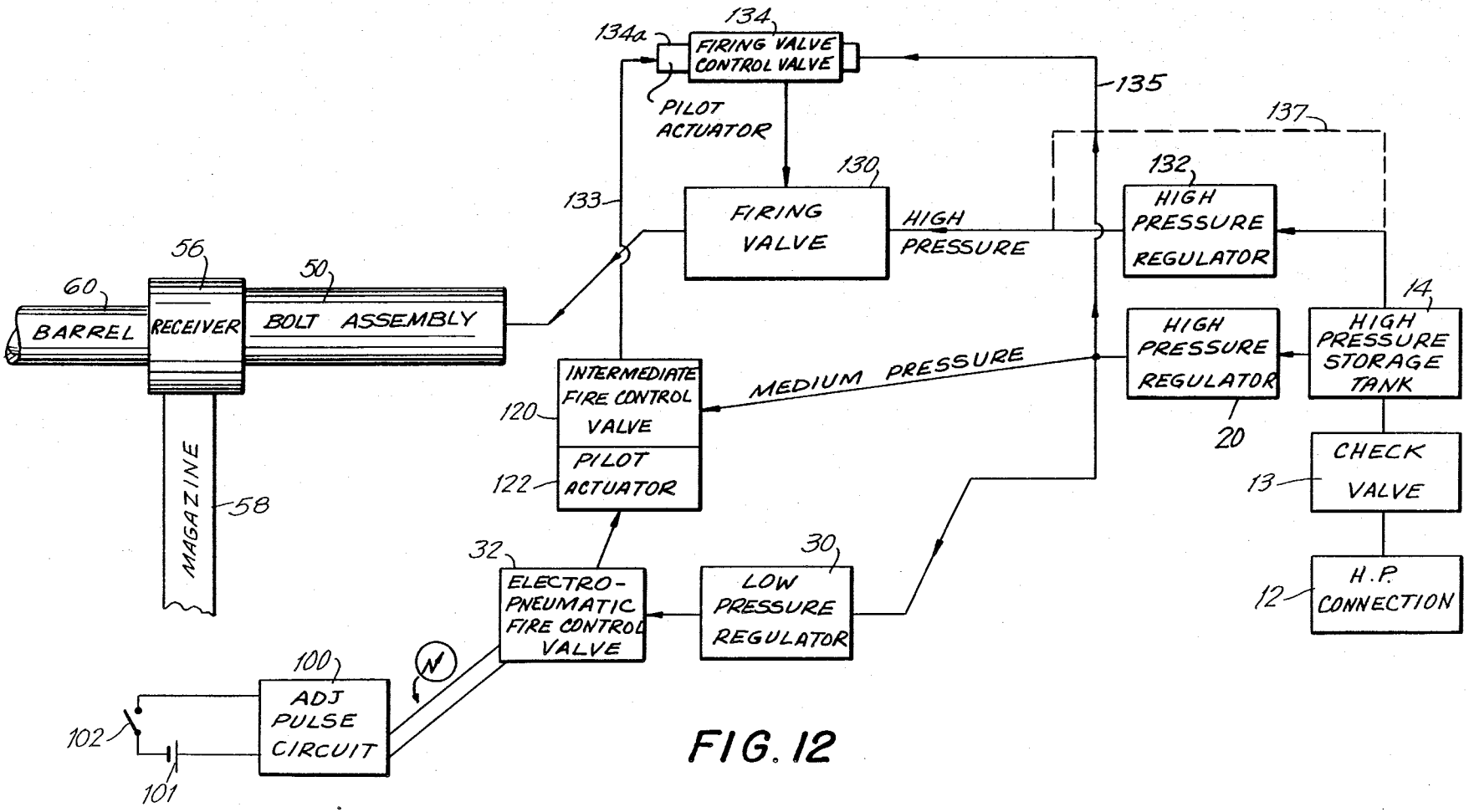
FIG. 12 is a schematic diagram of an electronic/-pneumatic weapon operating at high pneumatic pressures in accordance with the present invention.
Figure 13:
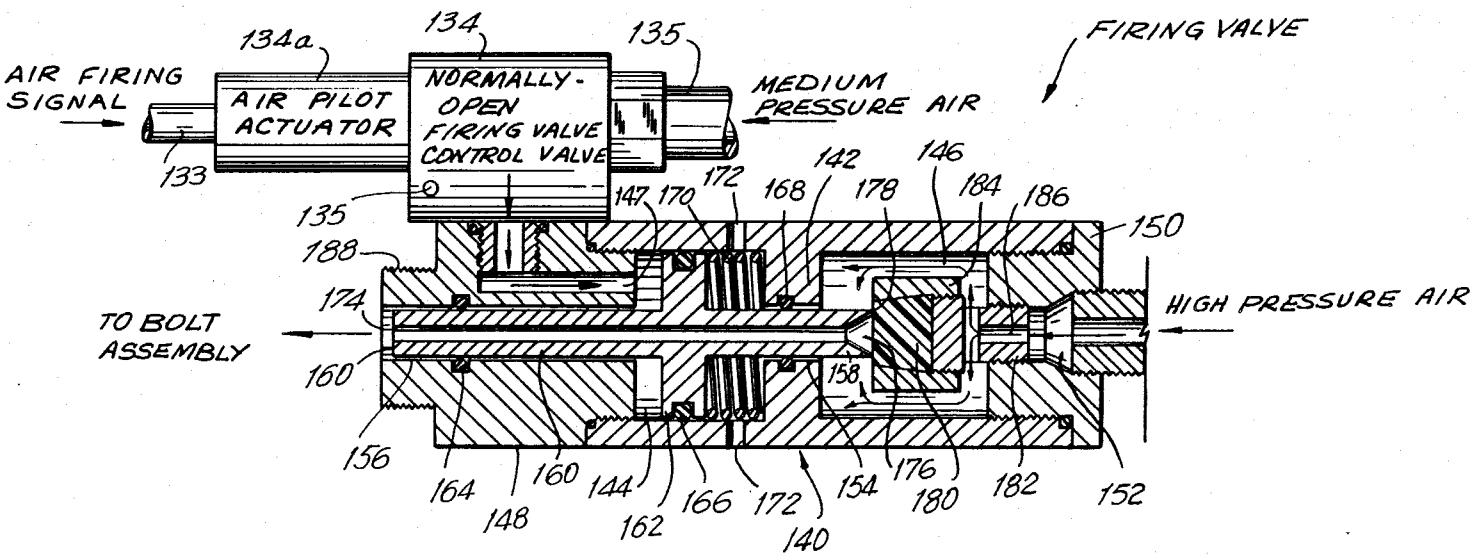
FIGS. 13, 14 and 15 are alternative embodiments of an improved firing valve in accordance with the teachings of the invention.
Figure 14:
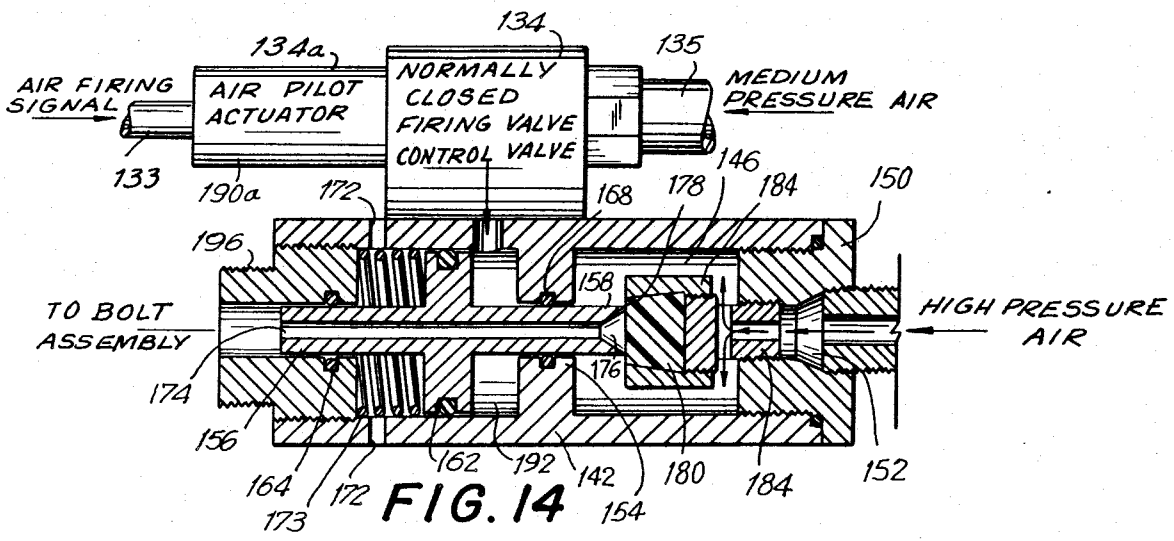
Figure 15:
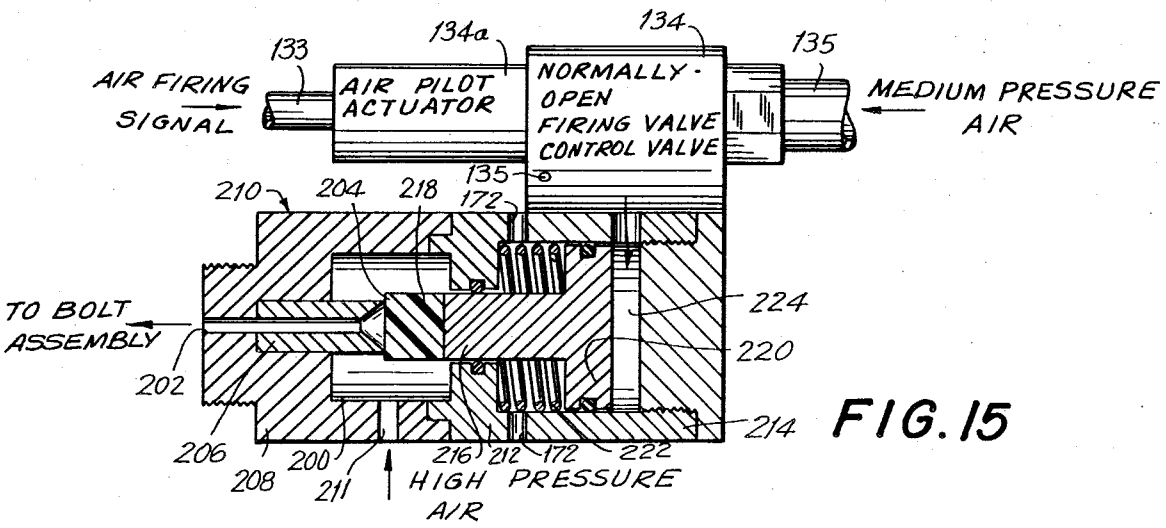

FIG. 12 is a schematic diagram of an embodiment of the pneumatic weapon which is capable of operation at higher firing pressures than the embodiments of FIGS. 1 and 11, allowing higher muzzle velocities to be obtained. In FIG. 12, components which have the same functions as components in FIGS. 1 and 11 are given the same number. Thus, the same high pressure supply system is used, up to and including high pressure regulator 20, as in the fire control system of FIG. 11, as well as intermediate fire control valve 120, and bolt assembly 50, receiver 56, and barrel 60. In FIG. 12, a novel firing valve 130 supplies high pressure air, at a level of 250 psi or more, from a separate high pressure regulator 132 for driving the bolt in bolt assembly 50. To this end, the output of intermediate firing control valve 120, at a medium pressure level of about 250 psi, is supplied to pilot valve **134*a*, which in turn actuates firing valve control valve 134 to supply air at medium pressure to high pressure firing valve 130. Firing valve 130, embodiments of which are shown in FIGS. 13–15, controls the supply of air to bolt assembly 50 at pressure levels above 250 psi, whereas the commercially available components used in the embodiments of FIGS. 1 and 11 for the firing valve would only function satisfactorily at firing valve pressures of up to about 300 psi. If desired, when the firing valve operating pressure used and the pressure in high pressure storage tank 14 are the same, high pressure air from the storage tank can be fed directly to firing valve 130 as shown in dashed line 137**, thereby saving space in the gunstock and reducing cost.

FIG. 13 shows a first embodiment of a high pressure firing valve 130 for use with the fire control system of FIG. 12. High pressure firing valve 130 consists of an essentially tubular body 140 which is divided in two by dividing wall 142 to provide a piston cylinder 144 and a high pressure valve chamber 146. Piston cylinder 144 is closed off by an end plug 148 and receives medium pressure air which is fed to it via a right-angled inlet passage 147 which is located off the axis of the valve body. End plug 148 also contains an outlet port 156 which extends axially outward from piston cylinder 144 and into which piston rod 160 extends. End plug 148 has threads 188 for coupling directly to bolt assembly 50. Valve chamber 146 is closed off by another end plug 150 which contains high pressure inlet port 152.

Dividing wall 142 contains an opening 154 which is coaxial with both inlet port 152 and outlet port 156. Slidably received in dividing wall opening 154 is valve stem 158, which extends towards inlet port 152. Piston 162 can travel axially in either direction in piston cylinder 144, with hermetic integrity of cylinder 144 being provided by means of O-ring 164, which is conformably fitted about piston rod 160, and by O-ring 166, which is carried on piston 162. A firing valve lift spring 170, shown as a coil spring, is enclosed between piston 162 and dividing wall 142, and O-ring 168 seals the passage of valve stem 158 through dividing wall 142. The spring chamber in which coil spring 170 thus resides is vented to the atmosphere by radial vents 172.

When the firing valve of FIG. 13 is actuated, high pressure air leaves the valve via the left-hand end of an axial passageway 174 which extends from high pressure opening 176 in valve stem 158 within piston 162, and through piston rod 160, and out to bolt assembly 50. Air to input opening 176 is supplied from pressure chamber 146 by moving the circular, knife-like valve edge 178, on the end of valve stem 158, away from the planar surface of plastic valve seat 180, which is preferably made of a polyacetal resin. The pressure seal provided by this knife-edge valve can sustain operating pressures of at least 3000 psi since, when the valve is closed, the pressure acts only on the side of stem 158, and since valve edge 178, when seated, digs into the plastic of the valve seat. Also, due to the thinness of the wall of stem 158, there is little area on which pressure in the valve chamber can act to produce an axial force when the valve is open. Thus, pressures as high as 3000 psi can easily be handled by the force made of medium pressure air in piston cylinder 144 on the many times larger surface of piston 162 exposed therein. Valve seat 180 is supported axially in the valve assembly by means of cap 184 on axial plug 182, which is screwed into high pressure inlet port 152. A T-shaped passageway 186 in axial plug 182 passes air from inlet port 152 to valve chamber 146. Air is supplied to high pressure air inlet 152 from high pressure regulator 132 of FIG. 12.

Operation of the firing valve of FIG. 13 is controlled by means of a normally-open three-way spool valve, acting as firing valve control valve 134 of FIG. 12, which receives medium pressure air. Spool valve 134 is actuated by an air pilot actuator 134*a* in the manner described in connection with the firing valves of the preceding embodiments. The medium pressure air from firing valve control valve 134 is fed to piston cylinder 144 in the firing valve via inlet passage 147 and, except when the weapon is being fired, is continuously present in piston cylinder 144. The air under pressure in piston cylinder 144 maintains valve edge 178 of valve stem 158 in contact with valve seat 180 and holds firing valve lift spring 170 under compression. When the weapon is fired, a pulse of air pressure is supplied to firing valve air pilot actuator 134 from intermediate control valve 120 (FIG. 12) and valve 134 is actuated to release the pressure from piston cylinder 144 via vent 135. The pressure of firing valve lift spring 170 against piston 162 raises valve edge 178 off of valve seat 180 and high pressure air flows into opening 176 and out through axial passageway 174. When the pneumatic firing signal supplied to pilot actuator 134*a* stops, three-way spool valve 134 reverses, closing off vent 135, and resupplying medium air pressure to piston cylinder 144. Piston 162 now moves to compress valve lift spring 170 and to re-seat valve edge 178 on valve seat 180, thereby stopping the flow of high pressure air through the pump valve.

Alternative embodiments of the firing valve of FIG. 13 are shown in FIGS. 14 and 15. The firing valve of FIG. 14 is designed to work with a firing valve control valve 134 which is a normally closed three-way poppet valve and which is actuated by air pilot actuator 134*a* in response to a pneumatic signal on line 133 to admit medium pressure air to piston cylinder 192. In this embodiment, piston cylinder 192 is situated between valve body dividing wall 142 and piston 162. Here firing valve lift spring 173 works between end plug 196 and piston 175, and in its expanded condition maintains valve edge 178 on valve stem 158 seated on valve seat 180. The structure of the high pressure chamber and of the support for valve seat 180 is the same as that shown in FIG. 13.

In operation, when air is admitted by firing valve control valve 134 to piston cylinder 192, the air acts upon piston 162 so as to lift valve edge 178 off of valve seat 180, allowing high pressure air to pass through passageway 174 in the same manner as was described in connection with the structure of FIG. 13. When air under pressure to piston cylinder 192 is cut off, spring 173 causes valve edge 178 to be reseated, cutting off the high pressure air to the firing bolt.

A third embodiment of a firing valve useful with the air-driven bolt of the invention is shown in FIG. 15, where high pressure air chamber 200 communicates high pressure air past the circular, knife-like valve edge 204 to outlet passage 202 in tubular knife-edge support 206, for delivery to bolt assembly 50. Tubular member 206 is coaxially inserted in end wall 208 of cup-shaped valve body 210. Cup-shaped valve body 210 is sealed to intermediate wall 212 of cylinder body 214. Projecting into high pressure chamber 200 through an axial hole 215 in cylinder body wall 212 is a piston rod 216. The end of piston rod 216 carries the plastic valve seat 219 of the previous embodiments and is movable axially to seat valve body 218 against circular valve edge 204.

In the embodiment of FIG. 15, coil spring 222 acts between dividing wall 216 and the adjacent surface of piston 220 to lift valve seat 219 off of stationary valve edge 204; the presence of air under pressure in piston cylinder 224 counters the action of coil spring 222 to seat valve seat 218 on valve edge 204. Now, when a pneumatic firing signal is supplied via line 133 (using again the spool valve of FIG. 15), air pilot actuator 134*a* actuates firing valve control valve 134 to cut off the supply of medium pressure air from line 133 to piston cylinder 224 and to vent the air from medium pressure chamber 224 via vent 135. This allows coil spring 222 to expand, lifting valve seat 218 from valve edge 204. When the pneumatic firing signal ceases, medium pressure air is once again admitted to piston cylinder 224 and valve seat 218 is again moved against valve edge 204 to cut off the flow of high pressure air to bolt assembly 50.

Of the three firing valves of FIGS. 13–15, that of FIG. 13 is particularly advantageous for use in a compact pneumatic weapon, in that the amount of force developed by air pressure in piston 144 for seating valve edge 176 against valve seat 180 can be easily regulated by adjusting the level of the medium pressure air to set the pressure on the seal. This is also true of the structure of FIG. 15, but this structure requires that the high pressure air be put into high pressure air chamber 200 via a side-located port 211, calling for lateral space, which is scarce in a gun stock.

Figure 16:
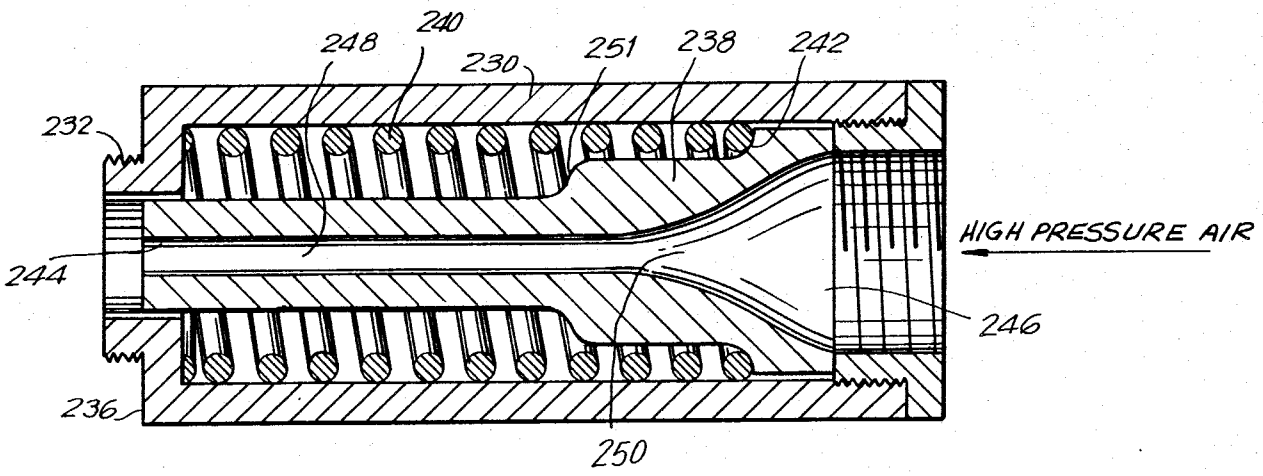
FIG. 16 is a sectional view of an alternative embodiment of the reciprocating bolt of the invention.

FIG. 16 shows an alternative embodiment to the bolt and bolt housing of the pneumatic weapon shown and described in connection with the embodiment of FIGS. 6–9. The bolt housing of FIG. 16 includes a cylindrical bolt housing having a forwardly projecting threaded nipple 232 which extends out of forward bolt housing wall 236 for engaging the rearward end of receiver 56. A tubular bolt 238 is movable forward, from the cocked position shown in the drawing, when driven, for example, by high pressure air from a firing valve 36 of FIG. 1 or a firing valve 130 of FIG. 11. Return spring 240 presses against radial flange 242 on the bolt, and when air pressure is not being supplied to the bolt, returns bolt 238 to the cocked position.

The forward end of bolt 238 of this embodiment has an outlet 244 which is smaller in cross-section than the rearward end 246 toward which high pressure air from the firing valve is directed. Instead of a transverse wall, the tubular passgeway 248, which connects its forward opening 244 and rearward opening 246, is provided with a throat portion 250 which acts like a Venturi, in that it accelerates the velocity of the air moving into passageway 248 from rearward opening 246 and, ultimately, the velocity of the projectile leaving the gun. At the same time, the air passing through the bolt is subject to considerable friction drag along the surface of the throat and tubular portion, which, together with the constriction provided by the throat, acts to accelerate the bolt to move it, as before, into contact with a projectile in position, and then into the breech of the gun barrel. In the illustrated embodiment, the constriction from the rearward end forward has the profile of a reverse curve, but it will be understood that a conical or other appropriate aerodynamic shape of the throat may be used. Transverse wall 251 serves to stop forward motion of the bolt when it strikes forward wall 236 of the bolt housing.

Figure 17:
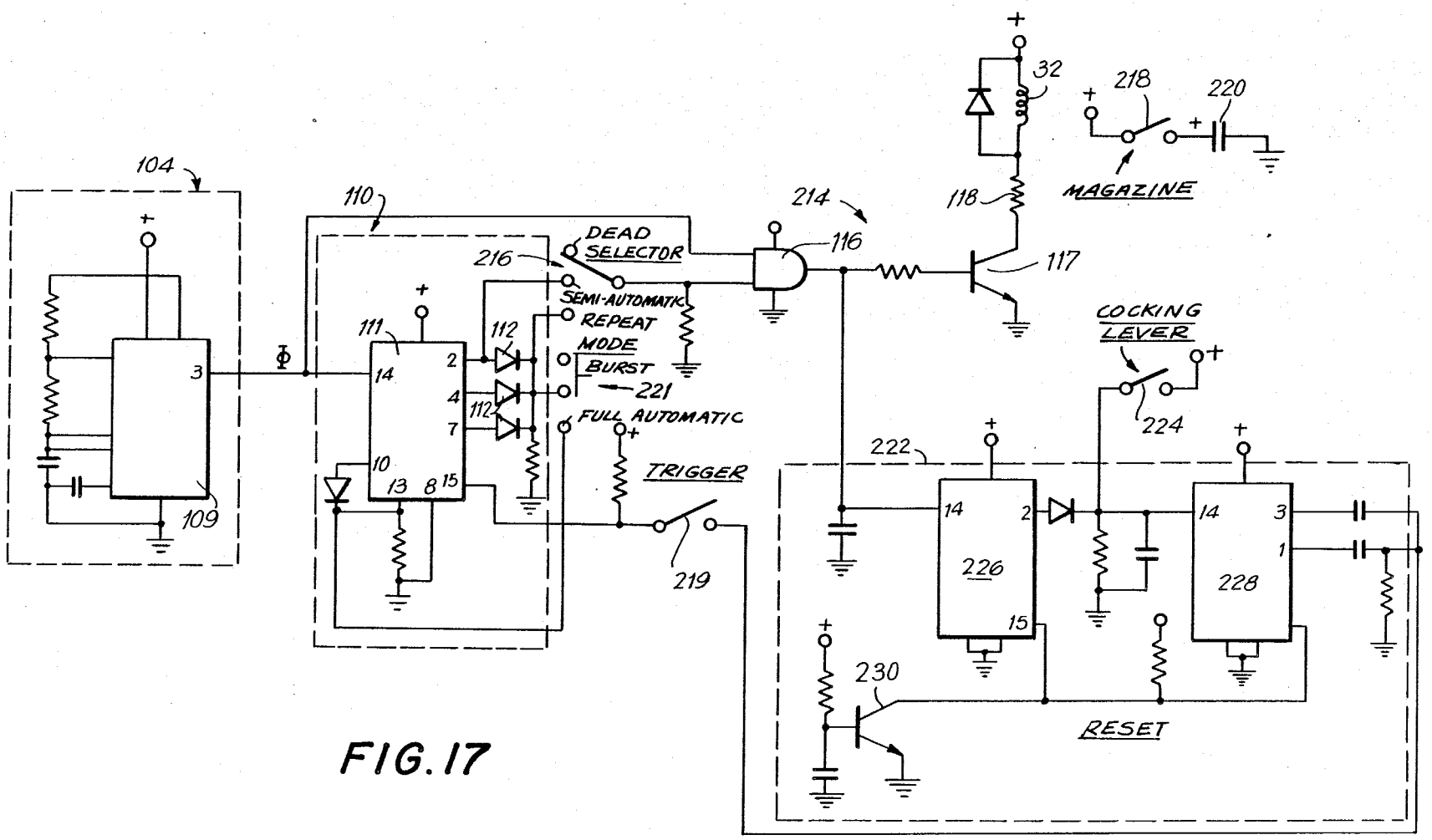
FIG. 17 is a schematic diagram of an alternative embodiment of the control circuit of the invention providing control features which mimic those of a conventional automatic firearm.

Reference is now made to FIG. 17 in which a modification of the electronic control circuit of FIG. 10 is illustrated for use in a pneumatic weapon simulating an M-16 rifle. Here, output of pulse generator 105 is fed, as in FIG. 10, to a counter circuit 110 and the output of the counter circuit is fed to a modified output switching and buffer circuit 214 which, via AND gate 116 and transistor 117, couples the outputs of pulse generator 105 and selector switch 112 to the coil of electronic/pneumatic poppet valve 32. Power switch 218 has been inserted into the positive lead which connects the circuit to battery 220. The switch is physically located in the receiver of the weapon so that the weapon cannot be fired unless a magazine is present in the receiver.

Other switches useful for emulating the M16 rifle are as follows. Three-way switch 216 emulates the selector switch of the rifle, and provides a dead position, a semi-automatic position, and a repeat position, as shown in FIG. 17. In the dead position, the weapon cannot be fired. In the semi-automatic position, semiautomatic operation in response to trigger switch 219 is enabled. In the repeat position, when mode switch 221 is in the burst position (open circuit), a burst of three, close-together, firing pulses is provided and, when mode switch 221 is in the full automatic position, rapid fire is provided.

To complete the simulation of the M16 functions, the pulse output of firing pulse gate 116 is fed to counter 222. Counter 222 counts up to thirty and disables trigger switch 219 when cocking lever switch 224 has not bee closed, or when thirty firing pulses have been fed to electronic/pneumatic firing control valve 32 and the magazine has not been replaced. In this way, the weapon cannot be fired when the magazine is empty, and the supply of air in high pressure air storage tank 14 is conserved.

Firing pulse counter 222 uses two type 4017 multi-decade counters, of the same type as counter 111. The input of counter 226 is supplied from the output of AND gate 116 and the output of counter 226 is taken from terminal 2 to be fed to the input of a second counter 228. The input to counter 228 is enabled by means of cocking lever switch 224 which must be closed to raise input 14 above ground potential. An output is taken from terminal 3 of second counter 228 and is fed, along with the output of terminal 1, to trigger switch 219.

When power is applied to the circuits of FIG. 17 by closing magazine switch 218, transistor 230 supplies a reset signal to the reset terminals of counters 226 and 228. However, trigger switch 219 is not enabled until cocking lever switch 224 has been closed, at which time the count in counter 228 is advanced by one, and terminal 3 goes high, enabling trigger switch 219. Now, when trigger switch 219 has been closed, whichever mode of fire has been selected by operation of selector switch 216 and mode switch 221 will be provided in the form of a single pulse, a burst of pulses, or a train of pulses in response to operation of the trigger (not shown) to which trigger switch 219 is attached. Counters 226 and 228 respond to each pulse which is fed to electronic/pneumatic firing control valve 32, counting to thirty. At the end of thirty counts, both terminal 3 and 1 of second counter 228 are driven low, and trigger switch 219 is disabled.

It will be apparent to those skilled in the art that many changes may be made in the structures of the invention described above. Thus, the electronic/-pneumatic poppet valve may be replaced by a valve which is actuated by an air signal rather than an electric signal. Further, other valves known in the art may be substituted for many of the illustrated valves in order to achieve the same functions.

It is also to be noted that while, in the illustrative embodiment of the invention, the electronic control circuit is composed of a number of discrete integrated circuits and passive electronic elements, it is possible to synthesize the entire electronic logic circuit in a single chip, thereby reducing the cost and simplifying manufacture of the pneumatic weapon of the invention.

It will thus be seen that the objects set forth above, and those made apparent from the preceding description, are efficiently attained. It will also be apparent to those skilled in the art that changes may be made in the construction without departing from the spirit. It is intended, therefore, that the above description and the drawings be interpreted as illustrative and that the following claims are to be interpreted in keeping with the spirit of the invention, rather than limited to the specific details set forth above.

It is also to be understood that the following claims are intended to cover all of the generic and specific features of the invention herein described and all statements of the scope of the invention which, as a matter of language, might be said to fall therebetween.

What is claimed is:

1. A pneumatic gun for firing a projectile, the gun comprising:

tubular barrel means comprising a breech, an axial bore, and a muzzle;

bolt housing means comprising a forward end, a substantially tubular bolt chamber and a rearward end;

coupling means joining the breech of the barrel means in axial alignment with the forward end of the bolt housing means, the coupling means providing a location at which a projectile can be positioned for firing;

traveling bolt means comprising a body having a forward portion containing an opening for directing gas at the location at which a projectile can be positioned, a rearward-facing opening for receiving a gas under pressure, and a tubular passageway therebetween, the traveling bolt means movable forward a sufficient distance from a rearward resting position in the bolt housing means so that the forward portion may traverse the location at which a projectile can be positioned for firing;

bias means acting between the bolt housing means and the traveling bolt means for urging the traveling bolt means rearward to the resting position;

means for directing gas under pressure into the rearward end of the bolt chamber so that, when the gas under pressure is supplied thereto, the traveling bolt means is driven forward by the gas under pressure to carry a projectile positioned at the location into the breech of the barrel means while gas under pressure passes through the tubular passageway to propel the projectile;

storage means for containing gas at relatively high pressure, the storage means having an output;

first high pressure regulator means having an input for gas at high pressure from the storage means and having an output for gas at a medium pressure;

low pressure regulator means for receiving gas at medium pressure from the first high pressure regulator means and for providing a low pressure output;

fire signal generating means for producing a firing signal;

fire control valve means having an input for low pressure gas from the low pressure regulator means an input for said firing signal, the fire control valve means adapted to be responsive to the firing signal to provide gas at low pressure as a pneumatic control signal;

second high pressure regulator means having an input for gas at high pressure from the storage means and having an output for gas at reduced pressure; and firing valve means having an input for receiving gas at reduced pressure from the second high pressure regulator means, the firing valve means adapted to be responsive to the pneumatic control signal to supply gas under reduced pressure toward said gas directing means for delivering gas to the traveling bolt means for firing the gun.

2. A pneumatic gun for firing a projectile in accordance with claim 1, wherein the forward opening of the traveling bolt means has a smaller cross-section than the rearward-facing opening of the traveling bolt means.

3. A pneumatic weapon in accordance with claim 2 wherein the change in cross-section is provided by an abrupt reduction of the dimensions of the tubular passageway.

4. A pneumatic gun in accordance with claim 2, wherein the change in cross section comprises a narrowing of the tubular passageway in a forward direction.

5. A pneumatic gun in accordance with claim 1, in which the traveling bolt means further comprises:

surface means extending laterally from the body of the traveling bolt means for extending the area on which the pressurized gas can act.

6. A pneumatic gun in accordance with claim 1 and further comprising:

stop means on the bolt housing means; and means on the traveling bolt means for engaging the stop means to limit forward travel of the traveling bolt means.

7. A pneumatic gun in accordance with claim 1, in which the rearward end of the tubular bolt chamber in the bolt housing means is larger in cross section than the forward end, and further comprising:

an intermediate section of tubular cross section connecting the forward end of the chamber to the rearward end, the transition between the forward end and the intermediate section serving as a seat for the bias means.

8. A pneumatic gun in accordance with claim 1, in which the bias means comprises a coil spring encircling a rearward portion of the traveling bolt means.

9. A pneumatic gun in accordance with claim 1, in which the coupling means comprises a receiver having a central space with which the breech of the barrel means and the forward section of the bolt housing means are in axial alignment, the location at which a projectile can be positioned being therebetween, and further comprising:

magazine means projecting into the central space for supplying projectiles in series to the firing location.

10. A pneumatic gun in accordance with claim 9, in which movement of the traveling bolt means from said rearward resting position to a fired position causes the forward portion of the traveling bolt means to remove a projectile from the magazine means as it travels into said breech preventing a positioning of another projectile at the firing location until the bolt is returned to a cocked position.

11. A pneumatic gun in accordance with claim 1 and further comprising:

said fire control valve means having an output for gas at low pressure means intermediate the output of the fire control valve means and the input of the firing valve means for raising the pressure level of the pneumatic control signal, the intermediate means having an input adapted to receive gas at medium pressure from the first pressure regulator means.

12. A pneumatic gun in accordance with claim 1 in which the fire control valve means comprises an electropneumatic valve, and in which the firing signal supplied thereto is electrical.

13. A pneumatic gun in accordance with claim 1 and further comprising:

means intermediate the fire control valve means and the firing valve means for raising the pressure level of the pneumatic control signal, the intermediate means having gas at medium pressure from the first pressure regulator means as an input and delivering the pneumatic control signal of medium pressure to the firing valve means.

14. A pneumatic gun in accordance with claim 1 wherein the firing valve means directs gas under pressure into the rearward end of the bolt chamber.

15. A pneumatic gun in accordance with claim 14, wherein the firing valve means directs gas under pressure axially towards the rearward-facing opening in the traveling bolt means.

16. A pneumatic gun in accordance with claim 15, wherein gas under pressure is supplied to the bolt housing means by said firing valve means, the firing valve means comprising:

valve body means including valve chamber means for receiving gas at high pressure and a control cylinder means for receiving said pneumatic control signal;

a tubular means having one open end in the valve chamber means and another open end coupled to the bolt housing means;

valve seat means supported in the valve chamber means for motion into and out of engagement with the one open end of the tubular means;

piston means in the control cylinder means, the piston means coupled to the valve seat means to move the valve seat means into and out of engagement with the one open end of the tubular means; and piston biasing means acting between the piston means and the valve body means for moving the valve seat means away from the one open end of the tubular means when the pneumatic control signal is not present in the control cylinder means.

17. A pneumatic gun in accordance with claim 1, in which the first high pressure regulator means further comprises:

regulator valve body means comprising a reduced pressure chamber having an outlet for gas, a spring chamber, an axially aligned stem chamber connecting the reduced pressure chamber and the spring chamber, an inlet for high pressure gas connected to the stem chamber, and an outlet for reduced pressure gas connecting the stem chamber to the reduced pressure chamber;

shuttle means disposed for reciprocal motion in the stem chamber, the shuttle means having a piston end disposed in the reduced pressure chamber and valve means disposed in the stem chamber; and spring contacting means disposed in the spring chamber to urge the shuttle means towards the reduced pressure chamber, the stem chamber valve means adapted to cut off a flow of gas from the high pressure inlet to the reduced pressure outlet when gas pressure in the low pressure chamber rises above a predetermined level.

18. A pneumatic gun in accordance with claim 1 wherein the flow of gas under pressure to the rearward end of the bolt housing means is controlled by said firing valve means wherein the firing valve means comprises:

valve body means including high pressure chamber means for receiving gas under high pressure and control cylinder means for receiving the pneumatic control signal;

tubular valve means having a first end in the high pressure chamber means and a second end coupled to the bolt housing means, the first end being movable into and out of seated relationship with a valve seat means in the high pressure chamber means for closing and opening the tubular valve means; and piston means in the control cylinder means, the piston means coupled to a valve stem means for moving the tubular valve means in response to the pneumatic control signal.

19. A pneumatic gun in accordance with claim 18 and further comprising:

piston bias means acting between the valve body means and the piston means for maintaining the tubular valve means seated on the valve seat means when the pneumatic control signal is not present.

20. A pneumatic gun in accordance with claim 18, wherein the pneumatic control signal is present in the control cylinder means except when a projectile is being fired, and further comprising:

piston bias means acting between the valve body means and the piston means for unseating the tubular valve means when the pneumatic control signal is absent from the control cylinder means.

21. A pneumatic gun in accordance with claim 18 in which the valve seat means comprises a plastic material.

22. A pneumatic gun in accordance with claim 18 in which the valve seat means comprises a polyacetal resin.

23. A pneumatic gun in accordance with claim 22 wherein the second end of the tubular valve means is mounted on a first side of the piston means, and further comprising:

piston rod means of a second side of the piston means; and passageway means through the piston means and the piston rod means for coupling high pressure gas from the tubular valve means to the tubular bolt chamber.

24. A pneumatic gun for firing a projectile, the gun comprising:

tubular barrel means comprising a breech, an axial bore, and a muzzle;

bolt housing means comprising a forward end, a substantially tubular bolt chamber, and a rearward end;

coupling means joining the breech of the barrel means in axial alignment with the forward end of the bolt housing means, the coupling means providing a location at which a projectile can be positioned for firing;

traveling bolt means comprising a body having a forward portion containing an opening for directing gas at the location at which a projectile can be positioned for firing, a rearwardfacing opening for receiving a gas under pressure, and a tubular passageway therebetween, the traveling bolt means movable forward a sufficient distance from a rearward resting position in the bolt housing means so that the forward portion may traverse the location at which a projectile can be positioned for firing;

bias means acting between the bolt housing means and the traveling bolt means for urging the traveling bolt means rearward to the resting position;

means for directing gas under pressure into the rearward end of the bolt chamber so that, when the gas under pressure is supplied thereto, the traveling bolt means is driven forward by the gas under pressure to carry a projectile when positioned at said location into the breech of the barrel means while gas under pressure passes through the tubular passageway to propel the projectile;

storage means for containing gas at high pressure, the storage means having an output;

high pressure regulator means having an input for gas from the storage means and having an output for gas at reduced pressure;

low pressure regulator means for receiving gas at reduced pressure from the high pressure regulator means and providing a low pressure output;

firing signal generating means for generating at least one electrical firing pulse, said firing pulse forming an electrical firing signal output for said generating means from which an electrical firing signal, is emitted said firing signal generating means establishing a mode and rate of firing;

electropneumatic fire control valve means having an input for low pressure gas from the low pressure regulator means and an input means for receiving said firing signal, the fire control valve means adapted to be responsive to the firing signal to provide a burst of low pressure gas as a pneumatic control signal;

firing valve means having an input for accepting gas at reduced pressure from the high pressure regulator means, the firing valve means adapted to be responsive to the pneumatic control signal to supply gas under reduced pressure to the traveling bolt means for firing the gun; and trigger means for causing the firing signal generating means to generate said at least one pulse.

25. A pneumatic gun in accordance with claim 24 in which the output of the firing signal generating means comprises a train of pulses for effecting continuous fire.

26. A pneumatic gun in accordance with claim 24 in which the output of the firing signal generator means comprises a burst of successive pulses.

27. A pneumatic gun in accordance with claim 24 in which the output of the firing signal generator means comprises a predetermined number of pulses for effecting burst fire.

28. A pneumatic gun in accordance with claim 24 in which the firing signal generating means further comprises:

firing mode selection means coupled to the firing signal generating means for enabling the selective generation of at least one of a single pulse, a burst of pulses, and a train of pulses as the electrical firing signal.

29. A pneumatic gun in accordance with claim 24, wherein the trigger means comprises an electric trigger switch, and further comprising:

cocking lever switch means for enabling operation of the trigger switch.

30. A pneumatic gun in accordance with claim 24 and further comprising:

magazine switch means for enabling operation of the firing signal generating means when a magazine is present adjacent said location at which a projectile can be positioned.

31. A pneumatic gun in accordance with claim 24, wherein the at least one electrical firing pulse comprises a plurality of electrical firing pulses the firing signal generating means comprises:

means for producing a continuous train of said electrical pulses;

counting means for receiving said continuous train of pulses and for producing a separate first count signal, second count signal and third count signal, and for combining said count signals; and buffer means for receiving said continuous train of pulses and said signals combined by said counting means to produce said firing signal.

32. A pneumatic gun in accordance with claim 24 and further comprising:

counter means for counting the number of said at least one electrical firing pulse coupled to the input means for receiving said firing signal of the fire control valve means limiting the electrical firing signal, the counting means stopping operation of the firing signal generating means when a predetermined number of said at least one electrical firing pulses have been generated.

33. A high pressure gas regulator means in accordance with claim 32, and further comprising:

relief valve means coupled to the reduced pressure output, the relief valve means comprising:

relief valve chamber means having a wall and a valve seat opening onto the reduced pressure output of the high pressure regulator means;

relief valve piston means seated on the valve seat opening;

spring support means on the wall of the relief valve chamber means; and spring means acting between the spring support means and the piston means to hold the piston means on the valve seat opening until pressure in the reduced pressure output exceeds a predetermined level.

* * * * *